US008145427B1

(12) United States Patent
Saleri et al.

(10) Patent No.: US 8,145,427 B1
(45) Date of Patent: Mar. 27, 2012

(54) ASSESSING PETROLEUM RESERVOIR PRODUCTION AND POTENTIAL FOR INCREASING PRODUCTION RATE

(75) Inventors: Nansen G. Saleri, Houston, TX (US); Robert M. Toronyi, Houston, TX (US)

(73) Assignee: QRI Group, LLC, Houston, TX (US)

( * ) Notice: Subject to any disclaimer, the term of this patent is extended or adjusted under 35 U.S.C. 154(b) by 355 days.

(21) Appl. No.: 12/567,404

(22) Filed: Sep. 25, 2009

Related U.S. Application Data

(60) Provisional application No. 61/101,024, filed on Sep. 29, 2008.

(51) Int. Cl.
*G01V 3/00* (2006.01)
*E21B 47/00* (2012.01)

(52) U.S. Cl. ..... 702/6; 166/252.1

(58) Field of Classification Search ... 702/6; 166/252.1, 166/268; 703/9, 10
See application file for complete search history.

(56) References Cited

U.S. PATENT DOCUMENTS

| | | | | |
|---|---|---|---|---|
| 3,035,440 | A | 5/1962 | Reed | |
| 7,445,041 | B2 | 11/2008 | O'Brien | |
| 7,890,264 | B2 * | 2/2011 | Elphick | 702/12 |
| 7,963,327 | B1 * | 6/2011 | Saleri et al. | 166/252.1 |
| 2002/0013687 | A1 | 1/2002 | Ortoleva | |
| 2002/0120429 | A1 | 8/2002 | Ortoleva | |
| 2005/0149307 | A1 | 7/2005 | Gurpiner et al. | |
| 2005/0209912 | A1 | 9/2005 | Venningen et al. | |
| 2007/0016389 | A1 * | 1/2007 | Ozgen | 703/10 |
| 2008/0091283 | A1 | 4/2008 | Balci et al. | |
| 2008/0262898 | A1 | 10/2008 | Tonchev et al. | |
| 2009/0133871 | A1 | 5/2009 | Skinner et al. | |
| 2010/0057418 | A1 | 3/2010 | Li et al. | |
| 2010/0082142 | A1 | 4/2010 | Usadi et al. | |

OTHER PUBLICATIONS

Saleri et al., "Engineering Control in Reservoir Simulation: Parts I and II", SPE 18305, 1988.
Saleri et al., "Data and Data Hierarchy", SPE 21369, pp. 1286-1293, Dec. 1992.
Saleri, "Reservoir Performance Forecasting: Acceleration by Parallel Planning", JPT, pp. 652-657, Jul. 1993.
Saleri, "'Learning' Reservoirs: Adapting to Disruptive Technologies", JPT, pp. 57-60, Mar. 2002.
Saleri et al., "The Expanding Role of the Drill Bit in Shaping the Subsurface", JPT, pp. 53-58, Dec. 2003.

(Continued)

*Primary Examiner* — Bryan Bui
(74) *Attorney, Agent, or Firm* — Workman Nydeggef

(57) ABSTRACT

Determining a production gain index (PGI) for a petroleum reservoir provides a novel leading indicator and metric that is designed to quickly assess the potential for increases in production of petroleum from an operating petroleum reservoir when implementing a recovery plan. The PGI can be determined according to the following equation:

$$PGI = \frac{\Sigma \Delta q_A}{\Sigma q_{Old}}$$

where, $\Sigma \Delta q_A$=net actual production gain of the reservoir; and $\Sigma$qOld=sum of current oil rates for existing producers. The PGI can also be determined according to the following equation:

$$PGI = PR \times (GPI - 1)$$

where, GPI=the global productivity index of the petroleum reservoir; and PR=the interference factor, which accounts for any losses in aggregate production gain due to well interference.

22 Claims, 7 Drawing Sheets

OTHER PUBLICATIONS

Saleri et al., "Shaybah-220: A Maximum-Reservoir-Contact (MRC) Well and Its Implications for Developing Tight-Facies Reservoirs", SPE Reservoir Evaluation & Engineering, pp. 316-320, Aug. 2004.

Saleri, "Reservoir Management Tenets: Why They Matter to Sustainable Supplies", JPT, pp. 28-30, Jan. 2005.

Saleri, "Tenets and Diagnostics in Modern Reservoir Management", 8th International Forum on Reservoir Simulation, Jun. 2005, Stressa, Italy.

Saleri, "The Next Trillion: Anticipating and Enabling Game-Changing Recoveries", JPT, Apr. 2006.

Saleri, "Haradh III: A Milestone for Smart Fields", JPT, Nov. 2006.

Saleri, "Dawn in the Desert: Saudi High Tech Paying Off at Ghawar", Energy Tribune, pp. 15-17, Sep. 2007.

Helman, "The Octopus", Forbes Energy & Genius, pp. 44-51, Nov. 24, 2008.

U.S. Appl. No. 12/392,891, filed Feb. 25, 2009, Office Action dated Dec. 8, 2010.

U.S. Appl. No. 12/392,891, filed Feb. 25, 2009, Notice of allowanced and issue fee dated Mar. 24, 2011.

U.S. Appl. No. 12/915,278 filed Oct. 29, 2010 Office Action dated Nov. 7, 2011.

U.S. Appl. No. 12/606,027 filed Oct. 26, 2009 Final Office Action dated Jan. 19, 2012.

U.S. Appl. No. 12/567,361 filed Oct. 25, 2009 Notice of Allowance dated Feb. 2, 2012.

* cited by examiner

ASSESSING PETROLEUM RESERVOIR PRODUCTION AND POTENTIAL FOR INCREASING PRODUCTION RATE

CROSS REFERENCE TO RELATED APPLICATIONS

This application claims the benefit of U.S. Provisional Application No. 61/101,024, filed Sep. 29, 2008, and entitled "ASSESSING PETROLEUM RESERVOIR PRODUCTION RATE THROUGH PRODUCTION GAIN INDEX", the disclosure of which is incorporated herein in its entirety.

BACKGROUND OF THE INVENTION

1. The Field of the Invention

The invention is in the field of petroleum recovery, more particularly in the field of assessing petroleum production rate and potential for increasing the rate of recovering petroleum from a petroleum reservoir.

2. The Relevant Technology

Petroleum is a critical fuel source and is the life blood of modern society. There is tremendous economic opportunity in finding and extracting petroleum. Due to a variety of technical and geological obstacles, it is typically impossible to recover all of the petroleum contained in a reservoir.

With regard to productivity, operators typically analyze each individual well to determine the rate of petroleum extraction, or well productivity. Operators typically do not understand how to evaluate and understand aggregate well activity and productivity for an entire reservoir or oil field.

Given the high cost of exploration, dwindling opportunities to find new petroleum reservoirs, and the rising cost of petroleum as a commodity, there currently exists a tremendous economic opportunity for accurately assessing productivity of a petroleum reservoir and the potential for productivity gains. Current methods for assessing productivity typically only evaluate individual wells, and there is no method of standard validation for the results over an entire reservoir. Moreover, because production and reservoir depletion continue during the assessment process, the results may in fact comprise obsolete data and assumptions. There is currently no known method for accurately assessing global productivity for a reservoir and the potential for increasing reservoir productivity in a short period of time (i.e., within days, weeks or months rather than years).

While the technology may, in fact, exist to increase the production rate of a petroleum reservoir, an impediment to implementing an intelligent long-term plan for maximizing current output, extending the life of a given reservoir, and increasing total recovery is the inability to accurately assess the health and deficiencies of the reservoir. For example, some or all of the producing wells of a reservoir may show diminishing output, which might lead some to believe the reservoir is drying up. However, the reservoir may, in fact, contain much larger quantities of recoverable petroleum but be under-producing simply due to poor placement and/or management of the existing wells and the failure to know whether and where to place new wells. The inability to properly diagnose inefficiencies and failures and implement an intelligent recovery plan can result in diminished short-term productivity and long-term recovery of petroleum from a reservoir.

In general, those who operate production facilities typically focus on oil well maintenance and may even implement the latest technologies for maximizing well output. They fail, however, to understand the total picture of health and productivity of the reservoir as a whole, which may be serviced by several wells. Wells are difficult and expensive to drill and operate. Once a given number of wells are in place, it may be economically infeasible to drill more wells in order to increase reservoir production (i.e., the marginal cost may exceed the marginal benefit). Moreover, there may be no apparent reason to shut down a producing well even though doing so might actually increase overall productivity and ultimate recovery. The knowledge of when and why to shut down or alter a producing well and/or properly construct a new well often eludes even the most experienced producers and well managers. The failure to properly manage existing wells and/or place and construct new wells can increase capital costs while reducing productivity and ultimate recovery.

The main impediment to maximizing production and recovery from a reservoir is the inability to gather, intelligently analyze, and correctly understand the relevant data. Diagnosing the health of a petroleum reservoir is not straightforward and is much like trying to decipher the health of a human body, but at a location far beneath the earth or ocean. Moreover, the available data may take years to accumulate and assess, yet may be dynamically changing, making it difficult, if not impossible, to formulate and implement an economically and/or technically feasible plan of action. The result is continuing low productivity and long-term recovery from the petroleum reservoir.

SUMMARY

Embodiments of the invention are directed toward determining, for a given petroleum reservoir, a Production Gain Index™ (PGI™), which is a measurement of the potential for increasing reservoir production, or rate of petroleum extraction, for the reservoir as a whole. The larger the Production Gain Index™ (PGI™), the greater is the potential for increasing reservoir productivity.

Determining the Production Gain Index™ (PGI™) is a new method for quickly estimating the net gain in oil rate for a developed oil field (or reservoir) as a result of increasing aggregate well productivity. The means by which the aggregate well productivity for a field may be increased include drilling additional producing wells, stimulation of existing wells, and increasing the reservoir contact of existing wells. The use of the Production Gain Index™ (PGI™) will enable engineers, managers, and investors to efficiently and quickly estimate the oil production rate, and financial gains, on a field basis when implementing certain types of capital projects.

In contrast to conventional methods in which the productivity of individual producing wells is assessed, the present invention considers the aggregate productivity of all producing oil wells of a petroleum reservoir. In general, the Production Gain Index™ (PGI™) is related to the Global Productivity Index™ (GPI™) and also the Interference Factor of the producing wells. The Interference Factor measures how the production level of a given well affects the production level of one or more adjacent wells.

In general, the dimensionless Production Gain Index™ (PGI™) can be defined by the following equation:

$$PGI = \frac{\Sigma \Delta q_A}{\Sigma q_{Old}}$$

where, $\Sigma \Delta q_A$=aggregate net actual production gain for all producers, stbpd (i.e., standard barrels produced per day); and $\Sigma g_{Old}$=sum of current oil rates for existing producers, stbpd.

In the case where the aggregate net actual production gain for all producers ($\Sigma\Delta q_A$) and/or the sum of current oil rates for existing producers ($\Sigma q_{Old}$) are not easily or readily determined, the Production Gain Index™ (PGI™) can also be determined and defined as a function of the Global Productivity Index™ (GPI™) according to the following equation:

$$PGI=PR\times(GPI-1)$$

where,

GPI=the Global Productivity Index™ (GPI™) of the petroleum reservoir; and

PR=Interference Factor, an empirically derived factor that accounts for the loss in the aggregate production gain due to well interference; if the wells do not interfere with each other, the Interference Factor becomes unity.

According to one embodiment, the Global Productivity Index™ (GPI™) can be defined according to the following equation:

$$GPI=\frac{\Sigma J_{New}}{\Sigma J_{Old}}$$

where, $\Sigma J_{New}$=sum of productivity indices of all producers post project development, stbpd/psi (i.e., standard barrels produced per day divided by pressure in pounds per square inch); and $\Sigma J_{Old}$=sum of productivity indices of all producers prior to project development, stbpd/psi.

The Interference Factor (PR) can be empirically derived and is also defined according to the following equation:

$$PR=\Sigma J_{New}/\Sigma J_{Old}.$$

Although the equations for determining the Interference Factor (PR) and Global Productivity Index™ (GPI™) appear to be the same, when determining the Interference Factor (PR) there is an embedded variable "d" within the productivity indices for producers post project development, which refers to the distance between adjacent producers. In other words, the ability of one or more wells to produce additional oil can be affected by the density or proximity of producing wells to each other. Increasing the production of one well can affect how much an adjacent well can product.

In general, the dimensionless Production Gain Index™ (PGI™) is based on the petroleum engineering concept of the productivity index (J), which is a measure of the ability of a well to produce. The ability of a well to produce is defined as a well's stabilized flow rate measured at surface conditions divided by the well's drawdown and is commonly expressed with the symbol J. A more detailed description of how to determine the productivity index for a well will be given hereafter. Additional details regarding the Interference Factor (PR) will also be discussed hereafter.

The Production Gain Index™ (PGI™) is a new leading indicator or metric designed to quickly assess the potential for gains in production in a producing petroleum reservoir. Embodiments of the invention provide management, engineers and investors with an effective new tool to identify opportunities to improve production rate with well-recognized financial benefits to involved parties. Notwithstanding its simplicity, indeed as a result of its simplified methodology compared to conventional practices, the present invention provides a revolutionary new tool that can quickly and efficiently assess the potential for productivity increases which, in turn, permits interested parties to device more effective and intelligent strategies for implementing measures to achieve desired productivity gains.

The Production Gain Index™ (PGI™) can advantageously be used as part of a more comprehensive reservoir evaluation system and methodology known as Reservoir Competency Asymmetric Assessment™ (or RCAA™), which is discussed more fully below in the Detailed Description.

These and other advantages and features of the present disclosure will become more fully apparent from the following description and appended claims, or may be learned by the practice of embodiments of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF PREFERRED EMBODIMENTS

I. Introduction and Background

Figure 1:
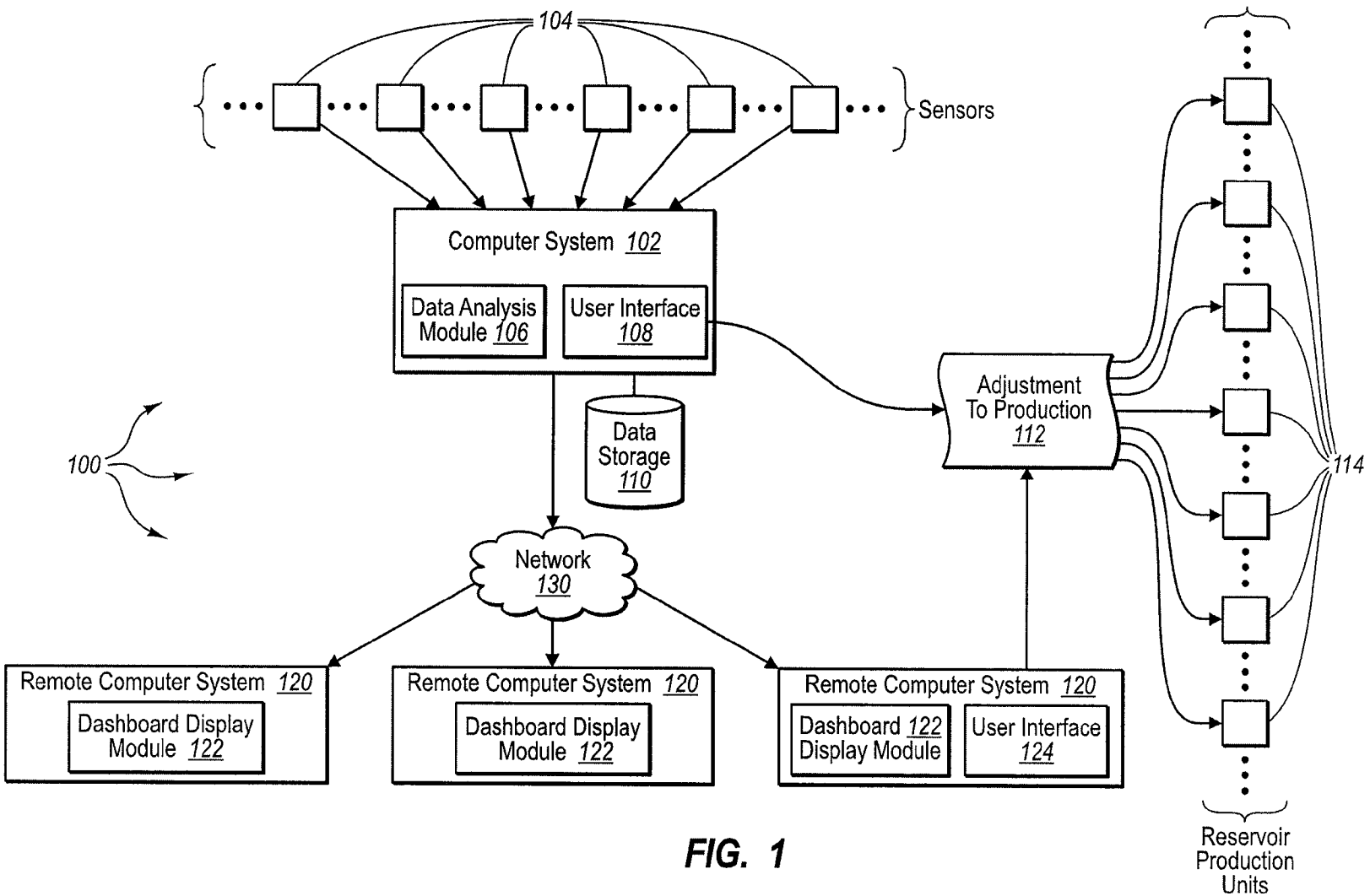
FIG. 1 schematically illustrates exemplary computer-implemented or controlled architecture that can be used to gather, analyze and/or display data gathered from and about a petroleum reservoir.

Preferred embodiments of the invention relate to the determination of a Production Gain Index™ (PGI™) for a petroleum reservoir, which is a novel leading indicator and metric that is designed to quickly assess the potential for increases in productivity an operating petroleum reservoir. Embodiments of the invention provide management, engineers and investors with an effective tool to identify opportunities to increase production of a petroleum reservoir with well-recognized financial benefits to involved parties.

The Production Gain Index™ (PGI™) is particularly useful when used in conjunction with, and as an important component of, a larger, more comprehensive system for assessing petroleum reservoir competency developed by the inventors and known as Reservoir Competency Asymmetric Assessment™ (or RCAA™). A comprehensive description of RCAA™ is set forth in U.S. patent application Ser. No. 12/392,891, filed Feb. 25, 2009 and entitled "METHOD FOR DYNAMICALLY ASSESSING PETROLEUM RESERVOIR COMPETENCY AND INCREASING PRODUCTION AND RECOVERY THROUGH ASYMMETRIC ANALYSIS OF PERFORMANCE METRICS". The foregoing application is incorporated herein in its entirety.

By way of background, RCAA™ includes several closely interrelated sub-methods or modules that are employed in concert and sequentially. They are (i) analyzing and diagnosing the specific and unique features of a reservoir (i.e., its "DNA") using targeted metrics, of which the Production Gain Index™ (PGI™) is one of the components, (ii) designing a recovery plan for maximizing or increasing current production and ultimate recovery of petroleum from the reservoir, (iii) implementing the recovery plan so as to increase current production and ultimate recovery of petroleum from the reservoir, and (iv) monitoring or tracking the performance of the petroleum reservoir using targeted metrics and making adjustments to production parameters, as necessary, to maintain desired productivity and recovery.

RCAA™ relies on intense knowledge gathering techniques, which include taking direct measurements of the physics, geology, and other unique conditions and aspects of the reservoir and, where applicable, considering the type, number, location and efficacy of any wells that are servicing, or otherwise associated with, the reservoir (e.g., producing wells, dead wells, and observation wells), analyzing the present condition or state of the reservoir using asymmetric weighting of different metrics, and prognosticating future production, recovery and other variables based on a comprehensive understanding of the specific reservoir DNA coupled with the asymmetric weighting and analysis of the data. In some cases, the gathered information may relate to measurements and data generated by others (e.g., the reservoir manager).

In general, RCAA™ is an assessment process which guides both the planning and implementation phases of petroleum recovery. All hydrocarbon assets carry an individual "DNA" reflective of their subsurface and surface features. RCAA™ is an enabling tool for developing and applying extraction methods which are optimally designed to the specifications of individual hydrocarbon reservoirs. Its main value is assisting in the realization of incremental barrels of reserves and production over and above levels being achieved using standard industry techniques. This, in turn, may reduce long-term capital and operating expenses.

According to one embodiment, implementation of RCAA™ spans six interweaving and interdependent tracks: i) Knowledge Systems; ii) Q6 Surveys; iii) Deep Insight Workshops; iv) Q-Diagnostics; v) Gap Analysis; and vi) Plan of Action. The information gathered from these tracks is integrated using modern knowledge-sharing mediums including web-based systems and communities of practice. While the overall business model of RCAA™ includes both technological and non-technological means for gathering the relevant information, the method cannot be implemented without the use of physical processes and machinery for gathering key information. Moreover, implementing a plan of action involves computerized monitoring of well activity. And enhanced reservoir performance results in a physical transformation of the reservoir itself.

Determining the Production Gain Index™ (PGI™) similarly involves physical processes and machinery for gathering key information. Converting such information, which relates to both the geological characteristics of the reservoir as well as operational attributes of the petroleum recovery plan, into a Production Gain Index™ (PGI™) is a transformation of essentially physical data into a diagnostic determination or score of the petroleum reservoir. To the extent that such transformations of data are carried out using a computer system programmed to generate the Production Gain Index™ (PGI™) from the underlying data, more particularly using a processor and system memory, such a computer system is itself a machine.

Because the subsurface plumbing of the reservoir is not homogeneous, it will often be necessary to statistically weight some data points more than others in order to come up with a more accurate assessment of the reservoir. In some cases, outlier data points may simply be anomalies and can be ignored or minimized. In other cases, outliers that show increased production gains for one or more specific regions of the reservoir which may themselves be the ideal and indicate that extraction techniques used in other, less productive regions of the reservoir need improvement.

Physical processes that utilize machinery to gather data include, for example, 1) coring to obtain down hole rock samples (both conventional and special coring), 2) taking down hole fluid samples of oil, water and gas, 3) measuring initial pressures from radio frequency telemetry or like devices, and 4) determining fluid saturations from well logs (both cased hole and open hole). Moreover, once a plan of action is implemented and production and/or recovery from the reservoir are increased, the reservoir is transformed from a lower-producing to a higher-producing asset.

Monitoring the performance of the reservoir before, during and/or after implementation of a plan of action involves the use of a computerized system (i.e., part of a "control room") that receives, analyzes and displays relevant data (e.g., to and/or between one or more computers networked together and/or interconnected by the internet). Examples of metrics that can be monitored include 1) reservoir pressure and fluid saturations and changes with logging devices, 2) well productivity and drawdown with logging devices, fluid profile in production and injection wells with logging devices, and oil, gas and water production and injection rates. Relevant metrics can be transmitted and displayed to recipients using the internet or other network. Web based systems can share such data.

FIG. 1 illustrates an exemplary computer-implement monitoring system 100 that monitors reservoir performance, analyzes information regarding reservoir performance, displays dashboard metrics, and optionally provides for computer-controlled modifications to maintain optimal oil well performance. Monitoring system 100 includes a main data gathering computer system 102 comprised of one or more computers located near a reservoir and linked to reservoir sensors 104. Each computer typically includes at least one processor and system memory. Computer system 102 may comprise a plurality of networked computers (e.g., each of which is designed to analyze a sub-set of the overall data generated by and received from the sensors 101 404). Reservoir sensors 104 are typically positioned at producing oil well, and may include both surface and sub-surface sensors. Sensors 104 may also be positioned at water injection wells, observation wells, etc. The data gathered by the sensors 104 can be used to generate performance metrics (e.g., leading and lagging indicators of production and recovery), including those which relate to the determination of the Recovery Deficiency Indicator™ (RDI™). The computer system 102 may therefore include a data analysis module 106 programmed to generate metrics from the received sensor data. A user interface 108 provides interactivity with a user, including the ability to input data relating to areal displacement efficiency, vertical displacement efficiency, and pore displacement efficiency. Data storage device or system 110 can be used for long term storage of data and metrics generated from the data, including data and metrics relating to the Recovery Deficiency Indicator™ (RDI™).

According to one embodiment, the computer system 102 can provide for at least one of manual or automatic adjustment to production 112 by reservoir production units 114 (e.g., producing oil wells, water injection wells, gas injection wells, heat injectors, and the like, and sub-components thereof). Adjustments might include, for example changes in volume, pressure, temperature, well bore path (e.g., via closing or opening of well bore branches). The user interface 108 permits manual adjustments to production 112. The computer system 102 may, in addition, include alarm levels or triggers that, when certain conditions are met, provide for automatic adjustments to production 112.

Monitoring system 100 may also include one or more remote computers 120 that permit a user, team of users, or multiple parties to access information generated by main computer system 102. For example, each remote computer 120 may include a dashboard display module 122 that renders and displays dashboards, metrics, or other information relating to reservoir production. Each remote computer 120 may also include a user interface 124 that permits a user to make adjustment to production 112 by reservoir production units 114. Each remote computer 120 may also include a data storage device (not shown).

Individual computer systems within monitoring system 100 (e.g., main computer system 102 and remote computers 120) can be connected to a network 130, such as, for example, a local area network ("LAN"), a wide area network ("WAN"), or even the Internet. The various components can receive and send data to each other, as well as other components connected to the network. Networked computer systems and computers themselves constitute a "computer system" for purposes of this disclosure.

Networks facilitating communication between computer systems and other electronic devices can utilize any of a wide range of (potentially interoperating) protocols including, but not limited to, the IEEE 802 suite of wireless protocols, Radio Frequency Identification ("RFID") protocols, ultrasound protocols, infrared protocols, cellular protocols, one-way and two-way wireless paging protocols, Global Positioning System ("GPS") protocols, wired and wireless broadband protocols, ultra-wideband "mesh" protocols, etc. Accordingly, computer systems and other devices can create message related data and exchange message related data (e.g., Internet Protocol ("IP") datagrams and other higher layer protocols that utilize IP datagrams, such as, Transmission Control Protocol ("TCP"), Remote Desktop Protocol ("RDP"), Hypertext Transfer Protocol ("HTTP"), Simple Mail Transfer Protocol ("SMTP"), Simple Object Access Protocol ("SOAP"), etc.) over the network.

Computer systems and electronic devices may be configured to utilize protocols that are appropriate based on corresponding computer system and electronic device on functionality. Components within the architecture can be configured to convert between various protocols to facilitate compatible communication. Computer systems and electronic devices may be configured with multiple protocols and use different protocols to implement different functionality. For example, a sensor 104 at an oil well might transmit data via wire connection, infrared or other wireless protocol to a receiver (not shown) interfaced with a computer, which can then forward the data via fast ethernet to main computer system 102 for processing. Similarly, the reservoir production units 114 can be connected to main computer system 102 and/or remote computers 120 by wire connection or wireless protocol.

II. Determining the Production Gain Index™ of a Petroleum Reservoir

Figure 2:
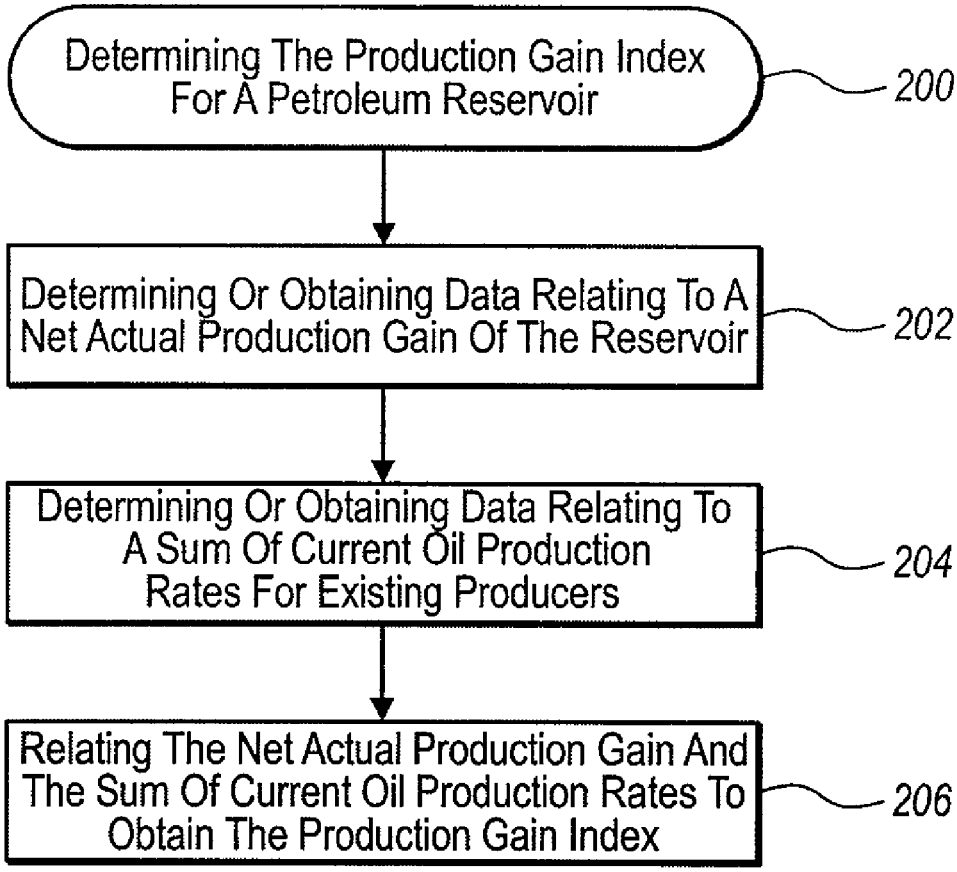
FIG. 2 is a flow diagram that illustrates exemplary acts for determining a Production Gain Index™ (PGI™) for a petroleum reservoir.

FIG. 2 is a block diagram that illustrates general acts or steps involved in a process 200 for determining the Production Gain Index™ (PGI™) of a petroleum reservoir. Process or sequence 200 includes an act or step 202 of determining or obtaining data relating to a net actual production gain of the petroleum reservoir post project development ($\Sigma\Delta q_A$). The process or sequence 200 further includes an act or step 204 of determining or obtaining data relating to a sum of current oil production rates for existing producers prior to project development ($\Sigma q_{Old}$). The process or sequence 200 further includes an act or step 206 of relating the net actual production gain of the petroleum reservoir ($\Sigma\Delta q_A$) with the sum of current oil production rates of the petroleum reservoir ($\Sigma q_{Old}$) to obtain the Production Gain Index™ (PGI™) for the petroleum reservoir such as, for example, according to the following equation:

$$PGI = \frac{\Sigma\Delta q_A}{\Sigma q_{Old}}$$

where, $\Sigma\Delta q_A$=aggregate net actual production gain for all producers post project development, stbpd (i.e., standard barrels produced per day); and $\Sigma q_{Old}$=sum of current oil rates for existing producers prior to project development, stbpd.

In the case where the aggregate net actual production gain for all producers ($\Sigma\Delta q_A$) and/or the sum of current oil rates for existing producers ($\Sigma q_{Old}$) are not easily or readily determined, the Production Gain Index™ (PGI™) can also be determined and defined as a function of the Global Productivity Index™ (GPI™) and Interference Factor (PR) according to the following equation:

$$PGI = PR \times (GPI - 1)$$

where,

GPI=the Global Productivity Index™ (GPI™) of the petroleum reservoir; and

PR=Interference Factor, an empirically derived factor that accounts for the loss in the aggregate production gain due to well interference; if the wells do not interfere with each other, the Interference Factor becomes unity.

Figure 3:
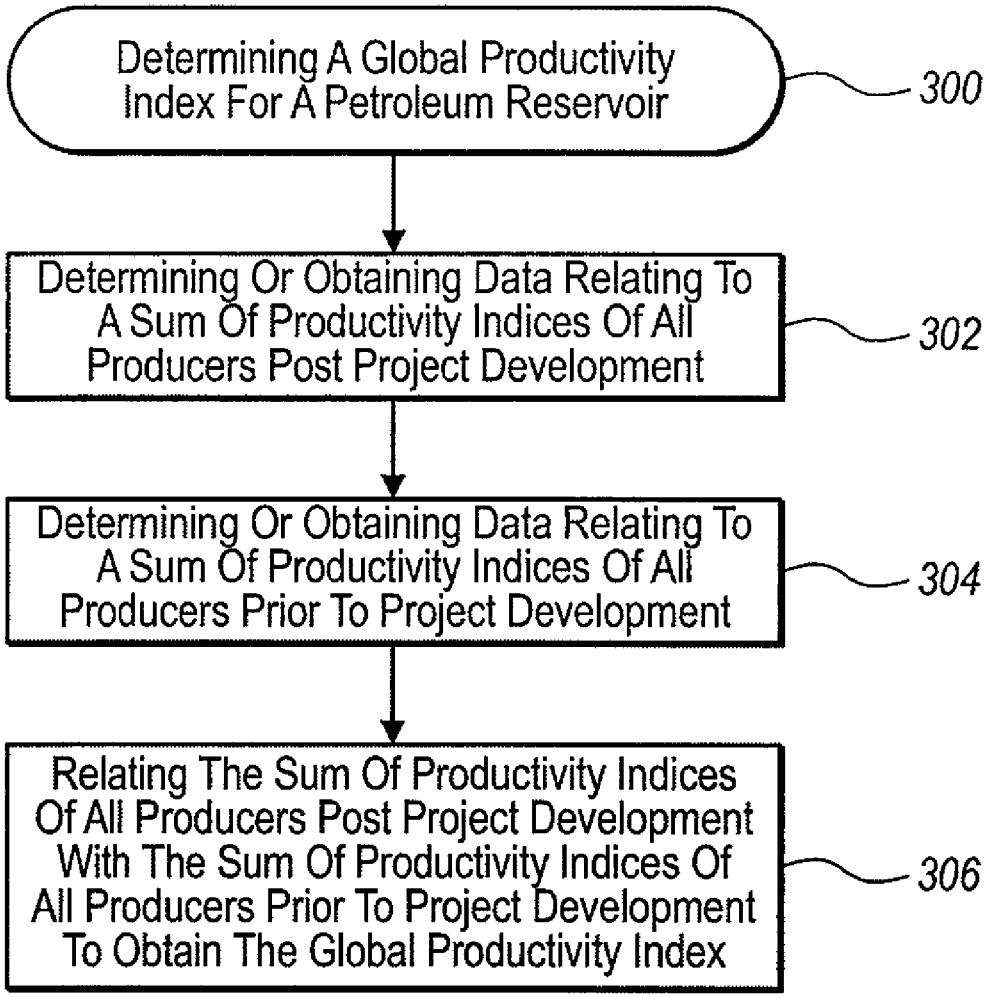
FIG. 3 is a flow diagram that illustrates exemplary acts for determining a Global Productivity Index™ (GPI™) for a petroleum reservoir.

FIG. 3 is a block diagram that illustrates general acts or steps involved in a process 300 for determining the Global Productivity Index™ (GPI™) of a petroleum reservoir. Process or sequence 300 includes an act or step 302 of determining or obtaining data relating to the sum of productivity indices of all producers post project development ($\Sigma J_{New}$). The process or sequence 300 further includes an act or step 304 of determining or obtaining data relating to the sum of productivity indices of all producers prior to project development ($\Sigma J_{Old}$). The process or sequence 300 further includes an act or step 306 of relating the sum of productivity indices of all producers post project development ($\Sigma J_{New}$) with the sum of productivity indices of all producers prior to project development ($\Sigma J_{Old}$) to obtain the Global Productivity Index™ (GPI™) for the petroleum reservoir such as, for example, according to the following equation:

$$GPI = \frac{\Sigma J_{New}}{\Sigma J_{Old}}$$

wHerein, $\Sigma J_{New}$=sum of productivity indices of all producers post project deployment, stbpd/psi;

$\Sigma J_{Old}$=sum of productivity indices of all producers prior project deployment, stbpd/psi.

Figure 4:
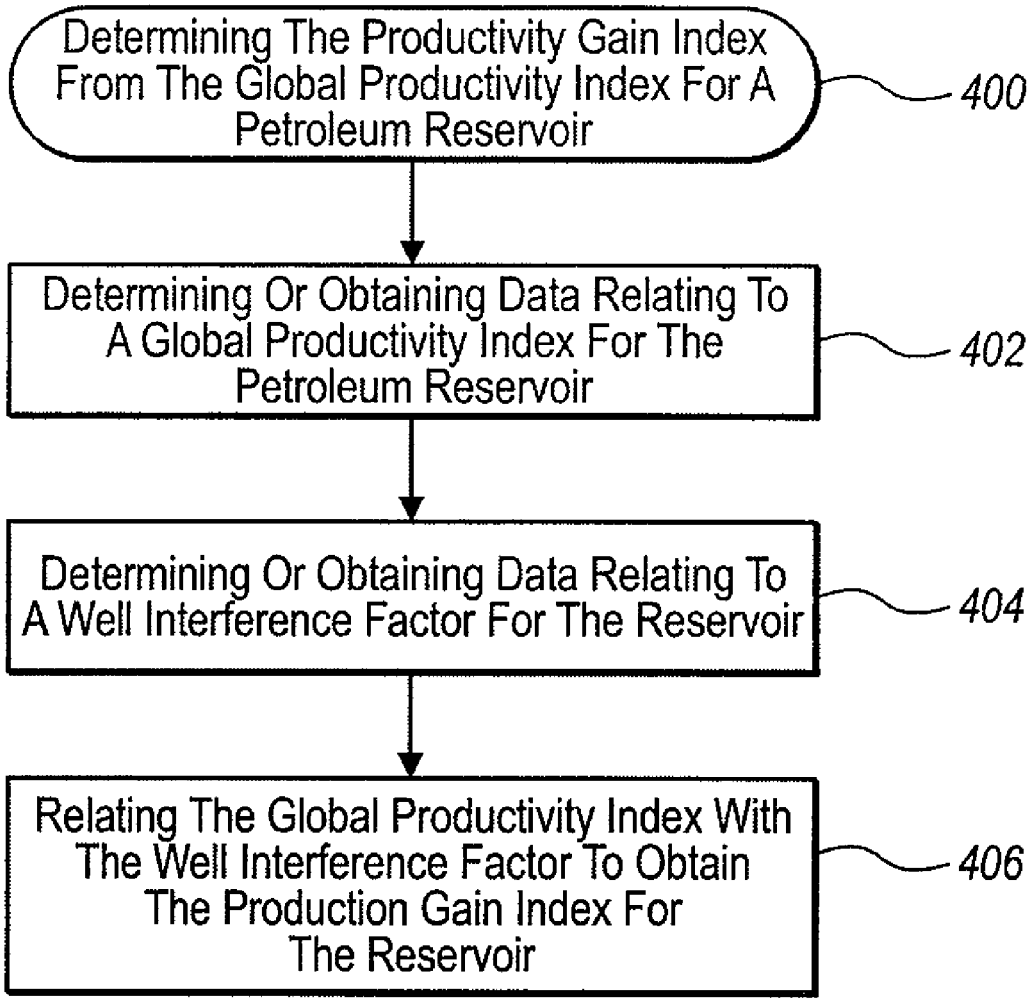
FIG. 4 is a flow diagram that illustrates exemplary acts for determining the Production Gain Index™ (PGI™) based on the Global Productivity Index™ (GPI™) and an Interference Factor for a petroleum reservoir.

FIG. 4 is a block diagram that illustrates general acts or steps involved in a process 400 for determining the Production Gain Index™ (PGI™) from the Global Productivity Index™ (GPI™) of a petroleum reservoir. Process or sequence 400 includes an act or step 402 of determining or obtaining data relating to the Global Productivity Index™ (GPI™) for the petroleum reservoir. The process or sequence 400 further includes an act or step 404 of determining or obtaining data relating to a well interference factor (PR) for the petroleum reservoir. The process or sequence 400 further includes an act or step 406 of relating the Global Productivity Index™ (GPI™) with the well interference factor (PR) to obtain the Production Gain Index™ (PGI™) for the petroleum reservoir such as, for example, according to the previously following referenced equation:

$$PGI = PR \times (GPI - 1)$$

where,

GPI=the Global Productivity Index™ (GPI™) of the petroleum reservoir; and

PR=Interference Factor, an empirically derived factor that accounts for the loss in the aggregate production gain due to well interference; if the wells do not interfere with each other, the Interference Factor becomes unity.

Figure 5:
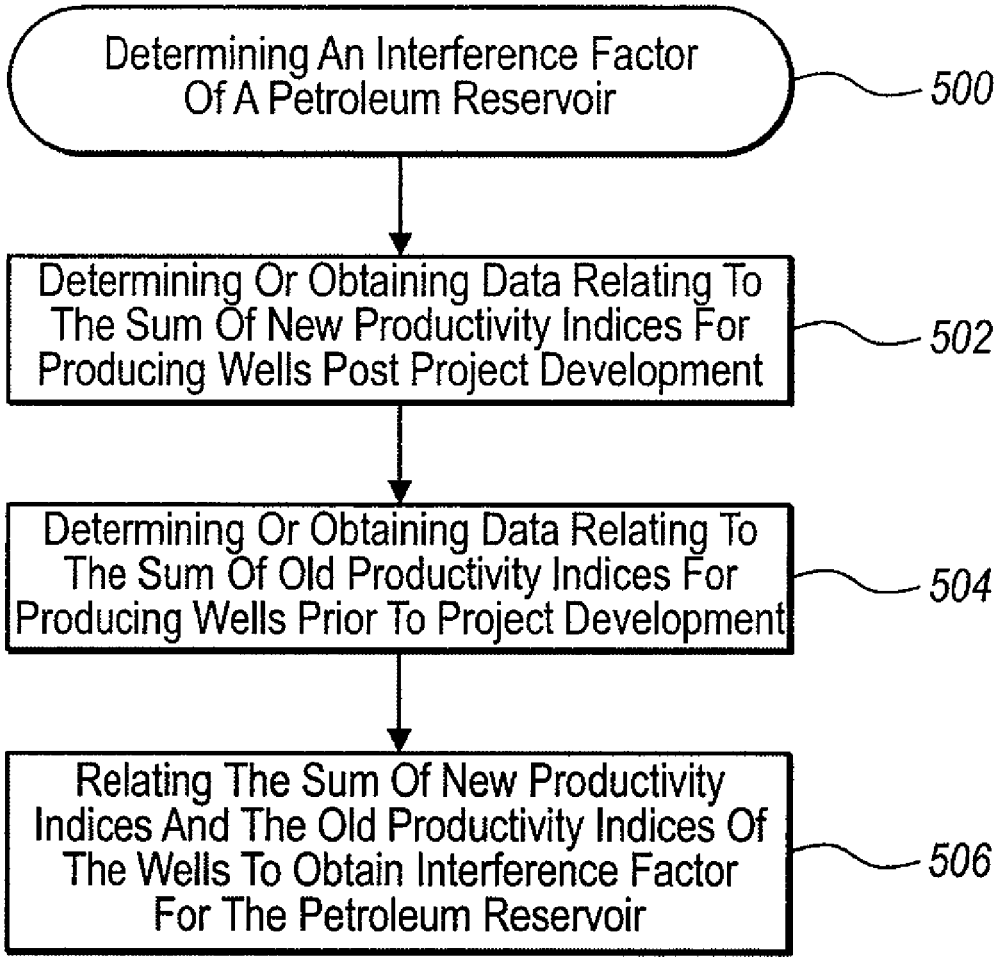
FIG. 5 is a flow diagram that illustrates exemplary acts for determining the Interference Factor (PR) for a petroleum reservoir.

FIG. 5 is a block diagram that illustrates general acts or steps involved in a process 500 for determining the Interference Factor (PR) of a petroleum reservoir. Process or sequence 500 includes an act or step 502 of determining or obtaining data relating to the sum of new productivity indices of all producers post project development ($\Sigma J_{New}$) in a manner that accounts for the distance (d) between wells, or well density. The process or sequence 500 further includes an act or step 504 of determining or obtaining data relating to the sum of old productivity indices of all producers prior to project development ($\Sigma J_{Old}$). The process or sequence 500 further includes an act or step 506 of relating the sum of new productivity indices of all producers post project development ($\Sigma J_{New}$) with the sum of old productivity indices of all producers prior to project development ($\Sigma J_{Old}$) to obtain the Interference Factor (PR) for the petroleum reservoir such as, for example, according to the following equation:

$$PR = \Sigma J_{New} / \Sigma J_{Old}.$$

wherein, $\Sigma J_{New}$=sum of new productivity indices of all producers post project deployment, stbpd/psi, which includes or accounts for distance (d) between adjacent wells; and $\Sigma J_{Old}$=sum of old productivity indices of all producers prior to project deployment, stbpd/psi.

The manner in which the distance (d) between adjacent wells is factored into the sum of new productivity indices of the producers post project development will be explained below.

The Production Gain Index™ (PGI™) is a new method for quickly estimating the net gain in oil rate for a developed oil field (or reservoir) as a result of increasing aggregate well production. The means by which the aggregate well productivity for a field may be increased include drilling additional producing wells, stimulation of existing wells, and increasing the reservoir contact of existing wells, such as by maximum reservoir contact (MRC) wells (See FIG. 6). The use of the Production Gain Index™ (PGI™) will enable engineers, managers, and investors to efficiently and quickly estimate the oil production rate, and financial gains, on a field basis when implementing certain types of capital projects.

Figure 6:
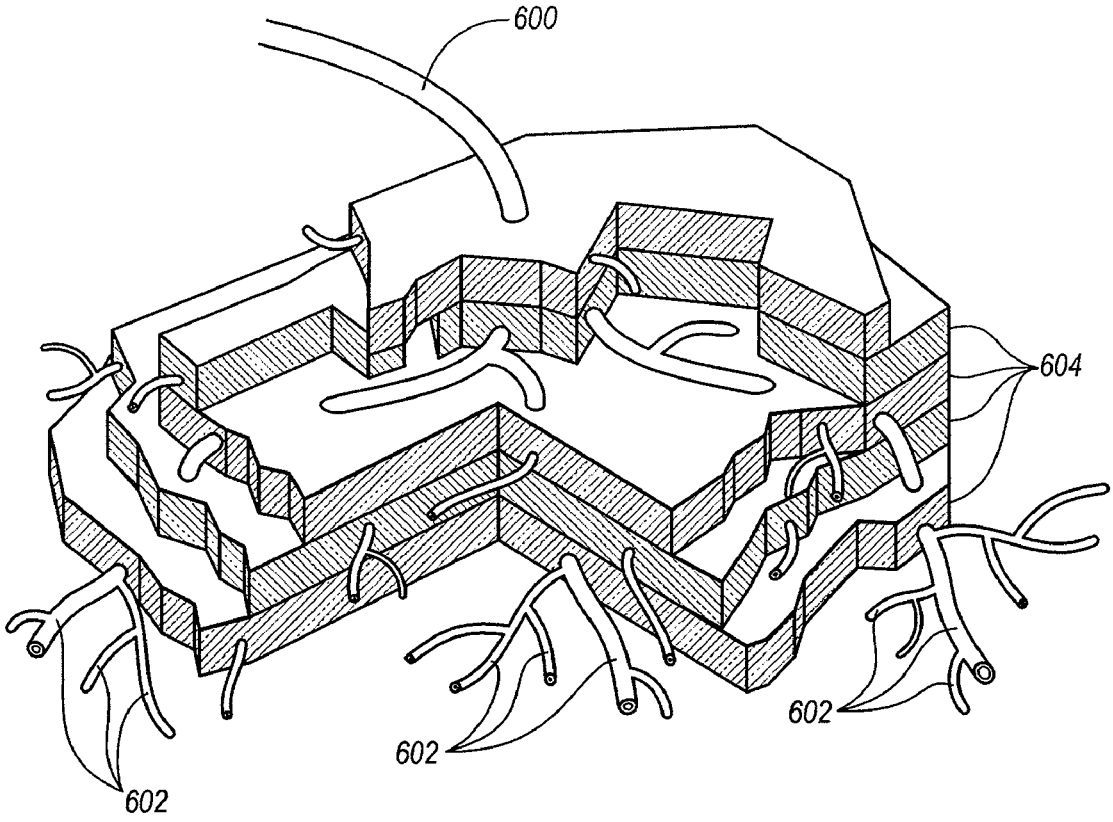
FIG. 6 illustrates an exemplary maximum reservoir contact (MRC) well used to increase productivity of a single producing oil well.

To maximize both daily production and long term productivity, a plan of action or production architecture may include the design and placement of at least one maximum contact well having a plurality of branched and at least partially horizontal well bores. This type of well is known as a "maximum reservoir contact" (MRC) well. An exemplary MRC well is schematically illustrated in FIG. 6, and includes a multiple branched well bore 600, including a plurality of spaced-apart well bore subsections 602 that extended generally horizontally through one or more strata 604 of the reservoir. The well bore subsections 602 may also be positioned vertically relative to each other in order to better drain oil found at different reservoir depths. In general, an MRC well can be used to better drain oil pockets that are generally fluidly interconnected.

The Production Gain Index™ (PGI™) is based on the petroleum engineering concept of the Productivity Index, which is an empirical relationship that measures the ability of a given well to produce. It is defined as a well's stabilized flow rate measured at surface conditions divided by the well's drawdown and is commonly expressed with the symbol J. Two test types yield the data required for this calculation and are referred to as "deliverability" and "transient tests".

To measure the Productivity Index, a pressure gauge is placed in a producing well near the interval of interest either by running on wire-line or from those permanently installed sub-surface. With this gauge the flowing bottom-hole pressure ($p_w$) is measured after the well has flowed at a stabilized rate for a sufficient period of time and a static pressure ($p_e$) is measured after a sufficient shut-in period. The drawdown is the difference in static bottom-hole pressure and stabilized flowing bottom-hole pressure ($p_e - p_w$). The well's flow rate is measured at the surface such as by, for example, from tank gauging or with a metered test separator.

Three parameters are considered as important in providing good test data. These are (1) complete rate stabilization, (2) placement of the pressure gauge prior to test initiation, (3) and meticulous documentation of what happens during the test. To ensure that a stabilized rate exists prior to testing, the rate should be checked for several days so that any problems, such as severe fluctuations, can be spotted and corrected. Failure to correct rate fluctuations in a timely manner will require postponement or modification of the testing procedure.

Accurate pressure data are essential to successful testing. Placement of the gauge as close as possible to the test interval will yield the best results. If this is not possible, useful data may be obtained from surface measurements, or for rod-pumped wells from fluid level measurements. If the pressure gauge is not located at the mid-point of the producing interval, the pressure measurements are depth corrected to the mid-point.

When wells do not interfere with each other, the Interference Factor (PR) becomes unity and $$PGI = GPI - 1.$$

If well interference is significant (PR<1) then the actual PGI will be less than that calculated based on the foregoing relationship. Multiple well fields under peripheral pressure maintenance, or active water drive should consider the effect of well interference on this relationship. The following example illustrates this point.

Example 1

Demonstration of the Effect of Well Interference

Figure 7:
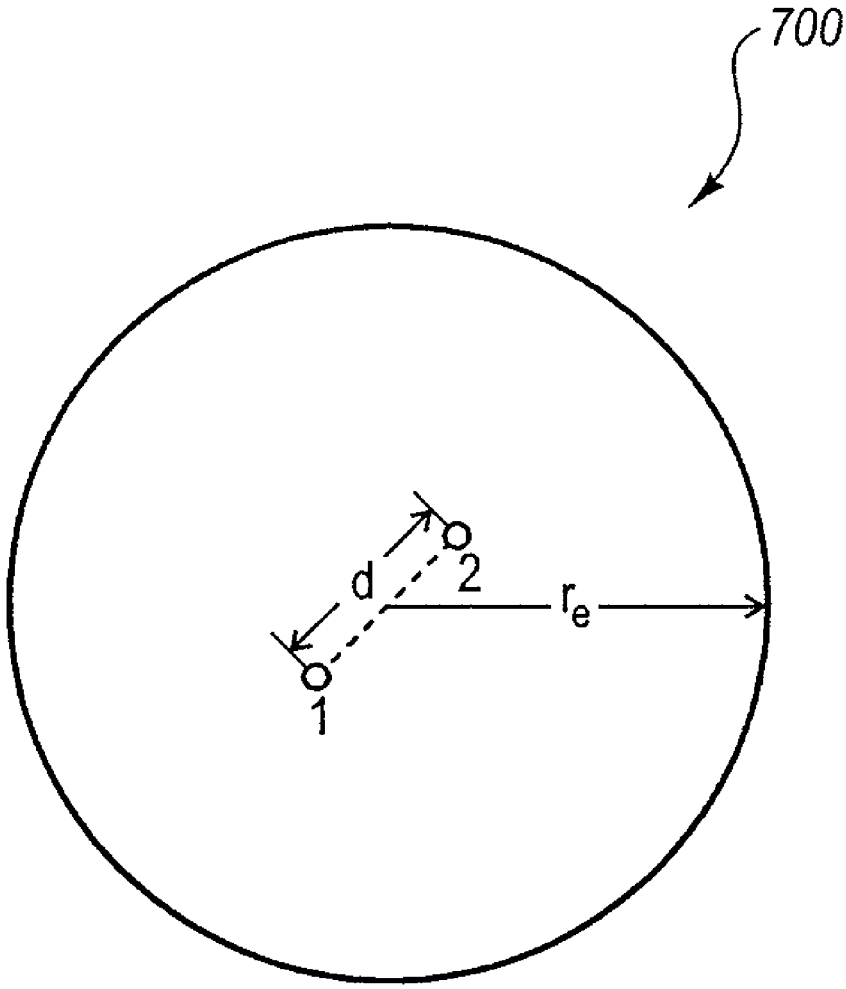
FIG. 7 schematically depicts a circular drainage area serviced by two producing wells.

With reference to FIG. 7, consider two wells in a hypothetical or actual circular drainage area 700 having a radius ($r_e$) and in which the wells are located at a distance (d) apart from each other. If well 1 is produced at an oil rate $q_1$, and well 2 is produced at an oil rate $q_2$, then the Productivity Index (PI) for well 1 can be determined as, $$J_{1New} = \frac{q_1}{p_e - p_w} = \frac{q_1}{\dfrac{\mu_o B_o}{7.08kh\left[q_1 \ln\left(\dfrac{r_e}{r_w}\right) + q_2 \ln\left(\dfrac{r_e}{d}\right)\right]}}$$

and for well 2 as.

$$J_{2New} = \frac{q_2}{p_e - p_w} = \frac{q_2}{\dfrac{\mu_o B_o}{7.08kh\left[q_1 \ln\left(\dfrac{r_e}{d}\right) + q_2 \ln\left(\dfrac{r_e}{r_w}\right)\right]}}$$

where, q is oil rate in stock-tank-barrels per day;

k is reservoir permeability in millidarcies;

h is formation thickness in feet;

$\mu_o$ is oil viscosity at reservoir conditions in centipoise;

$B_o$ is the oil formation volume factor in reservoir-barrels/stock-tank-barrels; and $r_w$ is the well-bore radius in feet.

Since these Productivity Indices are determined when both wells are producing they are considered as $J_{New}$. In order to determine $J_{1Old}$ then $q_2=0$ and the equation for $J_{Old}$ reduces to:

$$J_{1Old} = \frac{q_1}{p_e - p_w} = \frac{q_1}{\dfrac{\mu_o B_o}{7.08kh\left[q_1 \ln\left(\dfrac{r_e}{r_w}\right)\right]}}.$$

And in like form, when $q_1=0$ $$J_{2Old} = \frac{q_2}{p_e - p_w} = \frac{q_2}{\dfrac{\mu_o B_o}{7.08kh\left[q_2 \ln\left(\dfrac{r_e}{r_w}\right)\right]}}.$$

Thus, the productivity ratio for the two wells is defined as $$\frac{\Sigma J_{New}}{\Sigma J_{Old}}.$$

As an example, considering a reservoir in which $q_1=q_2$, $J_{1New}=J_{2New}$, $r_e=660$ feet, $r_w=0.333$ feet, and d=330 feet, then the productivity ratio is 0.92. This means the Productivity Index (PI) for both wells is reduced by 8%. For a given drawdown ($p_e-p_w$), if $q_1=100$ bpd and $q_2=0$ bpd, when the second well is produced at the same rate as the first ($q_1=q_2$), a sum total of 184 bpd is realized instead of 200 bpd. This reduced productivity ratio (i.e., 0.92) serves as the interference factor (PR).

If well interference were not considered, then the Production Gain Index™ (PGI™) could be defined as the increase of production resulting from adding a second well:

$$GPI = \frac{\Sigma J_{New}}{\Sigma J_{Old}} = (J_1 + J_2)/J_1 = (q_{\downarrow}1/(p_1e - p_1w) + q_1 2/(p_1e - p_{\downarrow}w))/q_1 1/(p_{\downarrow}e - p_1w) = 2.$$

In that situation, the Production Gain Index™ (PGI™) would be understood as $$PGI=(GPI-1)=2-1=1.$$

However, when taking into consideration well interference, the Production Gain Index™ (PGI™) when adding a second well according to this example becomes:

$$PGI=PR\times(GPI-1)=0.92(2-1)=0.92$$

For circular reservoirs with a constant pressure boundary in which reservoir pressure stabilizes under natural water drive or from pressure maintenance, the interference factor (PR) may be estimated as a function of Global Productivity Index™ (GPI™) according to the following relationship:

$$PR=1.1\times GPI^{-0.33}.$$

This relationship was determined from a statistical analysis of variable well densities for this particular reservoir type.

In short, the present invention provides a simple, yet powerful, diagnostic tool that can be used to quickly and accurately assess the Production Gain Index™ (PGI™) for a producing petroleum reservoir or oil field. The inventiveness of the disclosed methods lies in their simplicity and ease of implementation. Although sophisticated managers and operators of petroleum reservoirs have been assessing production rates for decades, and there has existed a long-felt need for finding improved and more streamlined methods for assessing opportunities for production gains, those of skill in the art have overlooked and failed to appreciate the powerful diagnostic power and quick implementation of the methods disclosed herein, which satisfy a long-felt need known in the art but heretofore unsatisfied. Moreover, the accuracy by which one may quickly determine a Production Gain Index™ (PGI™) for a reservoir, rather than individual producing wells, is unpredictable and an unexpected result.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. In a computing system having a processor and system memory and which is configured to receive and analyze data relating to net actual production gain and a sum of current oil rates for existing producers of a petroleum reservoir, a method for determining the production gain index (PGI) for a producing petroleum reservoir, comprising:

inputting into the computing system data relating to the net actual production gain of the petroleum reservoir ($\Sigma\Delta q_A$) post project development;

inputting into the computing system data relating to the sum of current oil rates for existing producers ($\Sigma q_{Old}$) of the petroleum reservoir prior to project development; and the computing system determining, by relating the net actual production gain ($\Sigma\Delta q_A$) of the petroleum reservoir post project development with the sum of current oil rates ($\Sigma q_{Old}$) of the petroleum reservoir prior to project development, the production gain index (PGI) for the petroleum reservoir.

2. The method as in claim 1, wherein the production gain index (PGI) is determined according to the following equation:

$$PGI = \frac{\Sigma\Delta q_A}{\Sigma q_{Old}}.$$

3. The method as in claim 1, further comprising using the production gain index (PGI) as part of a method for increasing current production of petroleum from the petroleum reservoir.

4. In a computing system having a processor and system memory and which is configured to receive and analyze data relating to a global productivity index and an interference factor for a petroleum reservoir, a method for determining the production gain index (PGI) for a producing petroleum reservoir, comprising:

inputting into the computing system data relating to a global productivity index (GPI) of the petroleum reservoir;

inputting into the computing system data relating to an interference factor (PR) of the petroleum reservoir; and the computing system determining, by relating the global productivity index (GPI) with the interference factor (PR), the production gain index (PGI) for the petroleum reservoir.

5. The method as in claim 4, wherein the production gain index (PGI) is determined according to the following equation:

$$PGI = PR \times (GPI - 1)$$

where,

GPI=the global productivity index of the petroleum reservoir; and

PR=the interference factor, which accounts for any loss in aggregate production gain due to well interference.

6. The method as in claim 4, wherein inputting into the computing system data relating to the global productivity index (GPI) of the petroleum reservoir further comprises:

inputting into the computing system data relating to a sum of productivity indices of all producers of the petroleum reservoir post project development ($\Sigma J_{New}$);

inputting into the computing system data relating to a sum of productivity indices of all producers of the petroleum reservoir prior to project development ($\Sigma J_{Old}$); and the computing system determining, by relating the sum of productivity indices of all producers of the petroleum reservoir post project development ($\Sigma J_{New}$) with the sum of productivity indices of all producers of the petroleum reservoir prior to project development ($\Sigma J_{Old}$), the global productivity index (GPI) of the petroleum reservoir.

7. The method as in claim 6, wherein the global productivity index (GPI) of the petroleum reservoir is determined according to the following equation:

$$GPI = \frac{\Sigma J_{New}}{\Sigma J_{Old}}.$$

where, $\Sigma J_{New}$=sum of productivity indices of all producers post project development, stbpd/psi (standard barrels produced per day divided by pressure in pounds per square inch); and $\Sigma J_{Old}$=sum of productivity indices of all producers prior to project development, stbpd/psi.

8. The method as in claim 4, wherein inputting into the computing system data relating to the interference factor (PR) of the petroleum reservoir further comprises:

inputting into the computing system data relating to a sum of productivity indices of all producers of the petroleum reservoir post project development ($\Sigma J_{New}$);

inputting into the computing system data relating to a sum of productivity indices of all producers of the petroleum reservoir prior to project development ($\Sigma J_{Old}$);

inputting into the computing system data relating to distances (d) between adjacent producers; and the computing system determining, by relating together the sum of productivity indices of all producers of the petroleum reservoir post project development ($\Sigma J_{New}$), the sum of productivity indices of all producers of the petroleum reservoir prior to project development ($\Sigma J_{Old}$), and the distances (d) between adjacent producers, the interference factor (PR) of the petroleum reservoir.

9. The method as in claim 8, wherein the interference factor (PR) of the petroleum reservoir is determined according to the following equation:

$$PR = \Sigma J_{New} / \Sigma J_{Old}$$

where, $\Sigma J_{New}$=sum of productivity indices of all producers post project development, stbpd/psi (standard barrels produced per day divided by pressure in pounds per square inch) and is based in part on data relating to the distances (d) between adjacent producers; and $\Sigma J_{Old}$=sum of productivity indices of all producers prior to project development, stbpd/psi.

10. The method as in claim 4, wherein the global productivity index (GPI) and interference factor (PR) are determined based on productivity indices of producing wells, wherein the productivity index (J) of each producing well is determined by:

inputting in the computing system data relating to a stabilized flow rate of the producing well at surface conditions;

inputting in the computing system data relating to a drawdown of the producing well; and the computer system determining the productivity index of the producing well by dividing the stabilized flow rate of the producing well at surface conditions by the drawdown of the producing well.

11. The method as in claim 10, wherein the drawdown of the producing well is determined by placing a pressure gauge in the producing well, measuring flowing bottom-hole pressure ($p_w$) after the well has flowed at a stabilized rate, measuring a static pressure ($p_e$) after a shut-in period, and determining the difference in static bottom-hole pressure and stabilized flowing bottom-hole pressure ($p_e - p_w$) for the well.

12. The method as in claim 10, wherein the stabilized flow rate of the producing well is measured at the surface by tank gauging or with a metered test separator.

13. The method as in claim 4, further comprising using the production gain index (PGI) as part of a method for increasing current production of petroleum from the petroleum reservoir.

14. In a computing system having a processor and system memory and which is configured to receive and analyze data relating to a global productivity index and an interference factor for a petroleum reservoir, a method for determining the production gain index (PGI) for a producing petroleum reservoir, comprising:

inputting into the computing system data relating to a sum of productivity indices of all producers of the petroleum reservoir post project development ($\Sigma J_{New}$);

inputting into the computing system data relating to a sum of productivity indices of all producers of the petroleum reservoir prior to project development ($\Sigma J_{Old}$);

inputting into the computing system data relating to distances (d) between adjacent producers;

the computing system determining, by relating the sum of productivity indices of all producers of the petroleum reservoir post project development ($\Sigma J_{New}$) with the sum of productivity indices of all producers of the petroleum reservoir prior to project development ($\Sigma J_{Old}$), a global productivity index (GPI) of the petroleum reservoir;

the computing system determining, by relating together the sum of productivity indices of all producers of the petroleum reservoir post project development ($\Sigma J_{New}$), the sum of productivity indices of all producers of the petroleum reservoir prior to project development ($\Sigma J_{Old}$), and the distances (d) between adjacent producers, the interference factor (PR) of the petroleum reservoir; and the computing system determining, by relating the global productivity index (GPI) with the interference factor (PR), the production gain index (PGI) for the petroleum reservoir.

15. The method as in claim 14, wherein the computing system determines the production gain index (PGI) according to the following equation:

$$PGI = PR \times (GPI - 1).$$

16. A computer program product comprising one or more physical storage media having stored thereon executable instructions which, when implemented by a computing system, will cause the computing system to carry out the method of claim 14.

17. A method for determining the production gain index (PGI) for a producing petroleum reservoir, comprising:

determining a sum of productivity indices of all producers of the petroleum reservoir post project development ($\Sigma J_{New}$);

determining a sum of productivity indices of all producers of the petroleum reservoir prior to project development ($\Sigma J_{Old}$);

determining distances (d) between adjacent producers;

determining, by relating the sum of productivity indices of all producers of the petroleum reservoir post project development ($\Sigma J_{New}$) with the sum of productivity indices of all producers of the petroleum reservoir prior to project development ($\Sigma J_{Old}$), a global productivity index (GPI) of the petroleum reservoir;

determining, by relating together the sum of productivity indices of all producers of the petroleum reservoir post project development ($\Sigma J_{New}$), the sum of productivity indices of all producers of the petroleum reservoir prior to project development ($\Sigma J_{Old}$), and the distances (d) between adjacent producers, the interference factor (PR) of the petroleum reservoir; and determining, by relating the global productivity index (GPI) with the interference factor (PR), the production gain index (PGI) for the petroleum reservoir.

18. The method as in claim 17, wherein the global productivity index (GPI) is determined according to the following equation:

$$GPI = \frac{\Sigma J_{New}}{\Sigma J_{Old}}.$$

where, $\Sigma J_{New}$=sum of productivity indices of all producers post project development, stbpd/psi (standard barrels produced per day divided by pressure in pounds per square inch); and $\Sigma J_{Old}$=sum of productivity indices of all producers prior to project development, stbpd/psi.

19. The method as in claim 17, wherein the productivity index (J) of each producing well is determined by:

measuring a stabilized flow rate of the producing well at surface conditions;

measuring a drawdown of the producing well; and dividing the stabilized flow rate of the producer at surface conditions by the drawdown of the producer.

20. The method as in claim 19, wherein the drawdown of the producing well is determined by placing a pressure gauge in the producing well, measuring flowing bottom-hole pressure ($p_w$) after the well has flowed at a stabilized rate, measuring a static pressure ($p_e$) after a shut-in period, and determining the difference in static bottom-hole pressure and stabilized flowing bottom-hole pressure ($p_e - p_w$) for the well.

21. The method as in claim 19, wherein the stabilized flow rate of the producing well is measured at the surface by tank gauging or with a metered test separator.

22. The method as in claim 17, further comprising using the production gain index (PGI) as part of a method for increasing current production of petroleum from the petroleum reservoir.

* * * * *

UNITED STATES PATENT AND TRADEMARK OFFICE

CERTIFICATE OF CORRECTION

PATENT NO. : 8,145,427 B1
APPLICATION NO. : 12/567404
DATED : March 27, 2012
INVENTOR(S) : Saleri et al.

It is certified that error appears in the above-identified patent and that said Letters Patent is hereby corrected as shown below:

Column 3
Line 46, change "product" to --produce--

Column 4
Line 57, change "productivity" to --productivity of--

Column 6
Line 55, change "101 404" to --104--
Line 56, change "at" to --at the--

Column 7
Line 11, change "example" to --example,--
Line 26, change "adjustment" to --adjustments--

Column 11
Line 22, change "and for well 2 as" to --and as for well 2--

Signed and Sealed this
Second Day of October, 2012

David J. Kappos
*Director of the United States Patent and Trademark Office*